US006408824B1

(12) United States Patent
Pacucci et al.

(10) Patent No.: US 6,408,824 B1
(45) Date of Patent: Jun. 25, 2002

(54) DEVICE FOR REGULATING THE DELIVERY PRESSURE OF A PUMP, FOR EXAMPLE, FOR FEEDING FUEL TO AN INTERNAL COMBUSTION ENGINE

(75) Inventors: Nicola Pacucci, Bari; Sisto Luigi De Matthaeis, Modugno, both of (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/607,244

(22) Filed: Jun. 30, 2000

(30) Foreign Application Priority Data

Jul. 2, 1999 (IT) ..... TO99A0571

(51) Int. Cl.[7] ..... F02M 37/04
(52) U.S. Cl. ..... 123/467; 123/506; 251/129.14
(58) Field of Search ..... 123/506, 467; 137/271; 251/129.14, 129.18

(56) References Cited

U.S. PATENT DOCUMENTS 4,252,094 A * 2/1981 Draxler ..... 251/129.14
4,714,089 A * 12/1987 Ueda et al. ..... 137/614.18
5,606,992 A * 3/1997 Erickson et al. ..... 251/129.14
5,785,299 A * 7/1998 Katsuta et al. ..... 251/129.18
5,878,965 A 3/1999 Coldren et al.
6,029,703 A * 2/2000 Erickson et al. ..... 251/129.15
6,045,120 A * 4/2000 Tarr et al. ..... 251/129.07
6,131,829 A * 10/2000 Ricco ..... 251/129.21
6,155,534 A * 12/2000 Steinruck et al. ..... 251/129.18

FOREIGN PATENT DOCUMENTS

DE 196 53 339 12/1996

* cited by examiner

*Primary Examiner*—Thomas N. Moulis
(74) *Attorney, Agent, or Firm*—Merchant & Gould PC

(57) ABSTRACT

The device includes a solenoid valve having a supply conduit communicating with the delivery of the pump, a drain conduit, an electromagnet energizable to control an armature controlling a shutter, and reducing means for reducing disturbance in the delivery pressure of the pump when the electromagnet is energized. The reducing means include a chamber having a predetermined volume and located between the supply conduit and the drain conduit; and a fixed shield having an opening in which slides a small-diameter portion of the stem of the armature. The electromagnet is controlled by an electronic unit via a modulator for modulating the duty cycle of the control pulses, and via a circuit for selecting the frequency of the control pulses on the basis of an estimate of hydraulic disturbances depending on at least one operating parameter.

18 Claims, 7 Drawing Sheets

DEVICE FOR REGULATING THE DELIVERY PRESSURE OF A PUMP, FOR EXAMPLE, FOR FEEDING FUEL TO AN INTERNAL COMBUSTION ENGINE

The present invention relates to a device for regulating the delivery pressure of a pump, e.g. for feeding fuel to an internal combustion engine.

BACKGROUND OF THE INVENTION

In modern engine fuel feed systems, a low-pressure pump draws the fuel from a tank and feeds it to a high-pressure pump, which in turn feeds it to a distributor or so-called "common rail" for supplying the engine cylinder injectors. To control and maintain a constant fuel pressure in the common rail, pressure-sensor-controlled devices are normally provided to drain any surplus fuel back into the tank.

Known pressure control devices normally comprise a solenoid valve in turn comprising a supply conduit communicating with the delivery conduit of the high-pressure pump, and a drain conduit communicating with the tank. The solenoid valve is also provided with a shutter located between the supply and drain conduits, and an electromagnet energized to control an armature controlling the shutter.

In one known pressure regulating solenoid valve, incorporated in a radial-piston pump, the electromagnet has a core with an annular solenoid; the armature is disk-shaped and fixed to a stem sliding inside a hole in the core coaxial with the solenoid; and the shutter is defined by a conical end of the stem, or by a ball controlled by the end of the stem.

Known regulating devices have several drawbacks. In particular, the fuel pressure in the delivery conduit is subject to various forms of disturbance, which impair operation of the engine, and which are caused, in particular, by the pulsating action of the high-pressure pump pistons, and by pulsating fuel delivery by the injectors.

Known devices are also subject to pressure disturbance caused by the piston effect of the armature stem, in turn caused by variations in fuel pressure when the supply conduit is opened. That is, upon the electromagnet opening the regulating solenoid valve, the delivery pressure acts immediately on the whole section of the stem, thus opening the solenoid valve instantaneously and causing the armature to vibrate.

The electromagnet is controlled by electric pulses having a given frequency, which, using the pulse width modulation (PWM) technique, also causes disturbance in the fuel pressure in the common rail; and, since the solenoid valve has a given resonance frequency, the resultant of the various forms of disturbance may, in certain conditions, generate resonance phenomena resulting in an enormous increase in disturbance.

SUMMARY OF THE INVENTION

It is an object of the present invention to provide an extremely straightforward, reliable device for regulating the delivery pressure of a pump, and which provides for eliminating the aforementioned drawbacks typically associated with known devices.

According to the present invention, there is provided a device for regulating the delivery pressure of a pump, e.g. for feeding fuel to an internal combustion engine, and comprising a solenoid valve in turn comprising a supply conduit communicating with the delivery of said pump, a drain conduit, a shutter between said supply conduit and said drain conduit, and an electromagnet energized variably to control an armature controlling said shutter; characterized by comprising reducing means for reducing disturbance in the delivery pressure of said pump.

More specifically, the reducing means comprise a cutoff chamber located between the supply conduit and the drain conduit, and of such a volume as to reduce the action of the variation in delivery pressure on the armature; and the armature comprises a cylindrical stem having a portion housed inside the cutoff chamber, and which is smaller in diameter than the stem, so as to increase the volume of the chamber.

In one embodiment of the invention, the cutoff chamber is closed by a fixed shield having an opening in which the smaller-diameter portion of the stem slides, so as to reduce the action of the fuel pressure on the stem.

If the electromagnet is controlled by an electronic unit comprising a pulse generator for generating pulses with a given frequency, and a pulse duty cycle modulator, the disturbance reducing means so condition the pulse generator as to generate a pulse frequency such as to avoid the resonance frequency of the solenoid valve.

BRIEF DESCRIPTION OF THE DRAWINGS

A number of preferred, non-limiting embodiments of the invention will be described by way of example with reference to the accompanying drawings, in which.

DETAILED DESCRIPTION OF THE INVENTION

Figure 1:
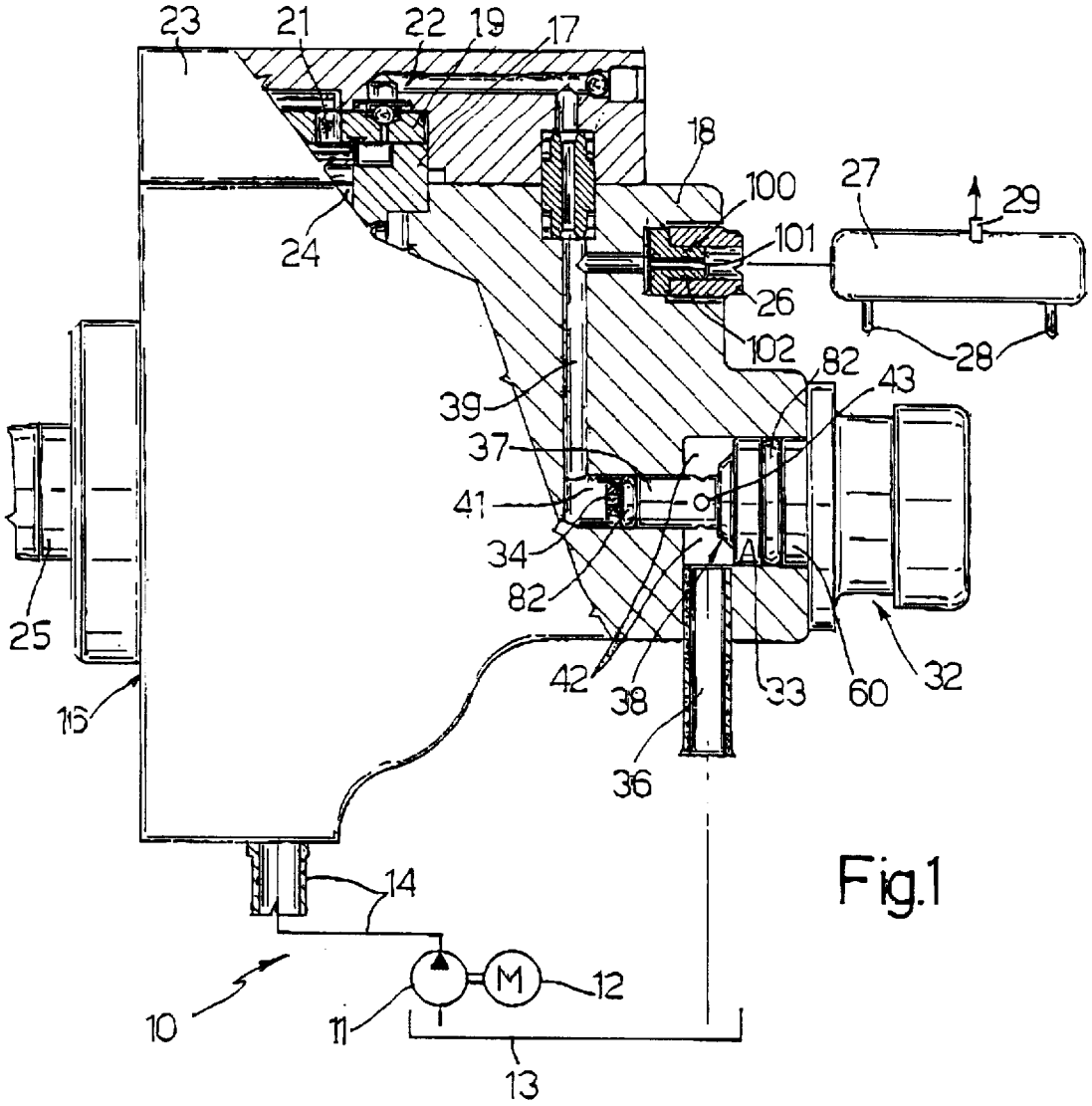
FIG. 1 shows a partly sectioned view of a high-pressure pump featuring a delivery pressure regulating device in accordance with the invention.

Number 10 in FIG. 1 indicates as a whole a fuel feed system for an internal combustion engine, e.g. a diesel engine. System 10 comprises a low-pressure pump 11 powered by an electric motor 12 to feed fuel from a normal vehicle tank 13 to the inlet conduit 14 of a high-pressure pump indicated as a whole by 16.

Pump 16 is a radial-piston type located on the internal combustion engine. More specifically, pump 16 comprises three cylinders 17 (only one shown in FIG. 1) arranged radially 120° apart on a pump body 18; each cylinder 17 is closed by a plate 19 supporting an intake valve 21 and a delivery valve 22; and each cylinder 17 and respective plate 19 are locked to pump body 18 by a corresponding head 23 of cylinder 17.

Three pistons 24 slide inside respective cylinders 17, and are activated in sequence by a single cam (not shown in FIG. 1) carried by a shaft 25 powered by the internal combustion engine drive shaft. Pistons 24 draw the fuel from conduit 14 through respective intake valves 21 and through respective delivery valves 22 to a common delivery conduit 26. High-pressure pump 16 provides for pumping the fuel up to pressures of about 1600 bar.

Figure 8:
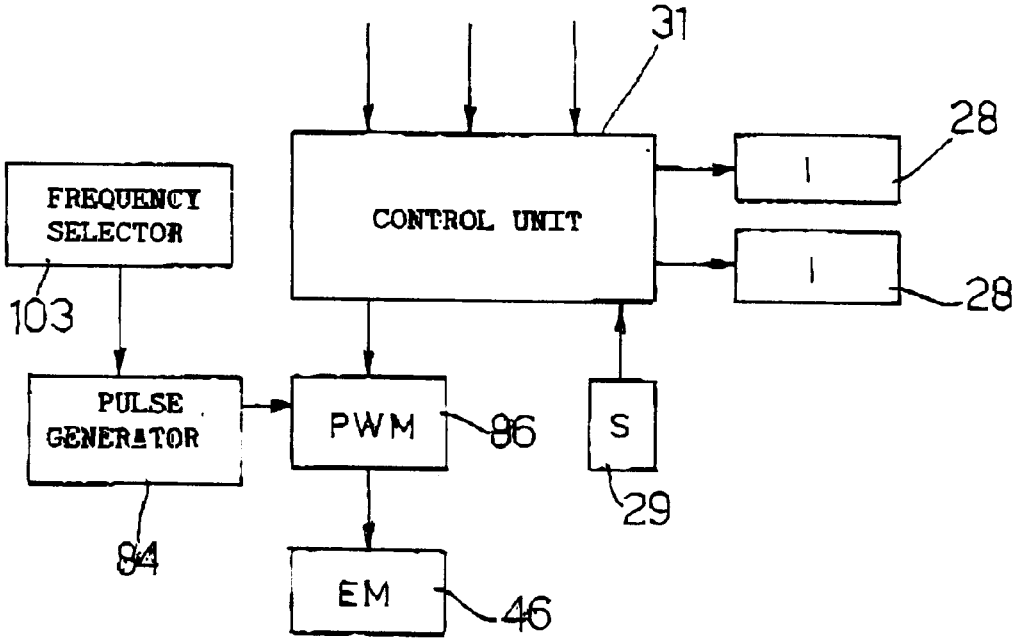
FIG. 8 shows a block diagram of an electronic unit for controlling the pressure regulating device.

Conduit 26 is connected to a pressurized-fuel distributor or vessel—indicated schematically by 27 and hereinafter referred to as a common rail—which supplies the usual fuel injectors 28 of the internal combustion engine cylinders. A pressure sensor 29 on common rail 27 is connected to an electronic control unit 31 (see also FIG. 8) to control the fuel pressure in common rail 27.

Pump 16 has a delivery pressure regulating device comprising a solenoid valve indicated as a whole by 32, and which is fitted inside a seat 33 in pump body 18 and in turn comprises a supply conduit 34 and a drain conduit 36. More specifically, supply conduit 34 is fitted axially to a first cylindrical portion 37 of a valve body 38.

Supply conduit 34 comprises a calibrated-diameter portion 35, and communicates with delivery conduit 26 via a radial channel 39 and a cavity 41 in pump body 18. Drain conduit 36 is fitted radially to pump body 18 and, via an annular cavity 42, communicates with a series of radial holes 43 in portion 37. A shutter, in the form of a ball 44 (FIG. 2), is located between supply conduit 34 and radial holes 43, and engages a conical seat 45, formed at the outlet of portion 35, to close conduit 34.

Solenoid valve 32 also comprises a control electromagnet indicated as a whole by 46 and having a ferromagnetic core 47 in turn having an annular seat 48 housing an annular solenoid 49. Unit 31 (see also FIG. 8) variably energizes electromagnet 46 to control an armature 51 controlling ball 44. More specifically, armature 51 is a disk type, and is fitted to a cylindrical stem 52 guided to slide inside an axial hole 53 in core 47.

Core 47 is formed integrally with a hollow cylindrical portion 54, in which is fitted in fluidtight manner a head 56 for closing electromagnet 32. Head 56 is made of nonmagnetic metal material, and has a chamber 55 housing armature 51 and so defining the armature chamber. Head 56 also has a central cavity 58 housing a compression spring 59 preloaded to normally push armature 51 towards the pole pieces of core 47 and so keep ball 44 in the closed position closing supply conduit 34 with a given force.

Core 47 also has a cylindrical appendix 60 having an inner shoulder 57 forming an axial seat 61, in which is fitted a second cylindrical portion 62 of valve body 38 larger in diameter than portion 37. Valve body 38 comprises a cylindrical axial cavity 63 substantially of the same diameter as hole 53 in core 47 to enable the end of stem 52 to engage ball 44.

Cavity 63 communicates with radial holes 43, and extends up to the plane of the base of conical seat 45. The volume of cavity 63 not occupied by stem 52 and by ball 44 defines a cutoff chamber 64 for cutting off the hydraulic wave between supply conduit 34 and drain conduit 36.

Figure 2:
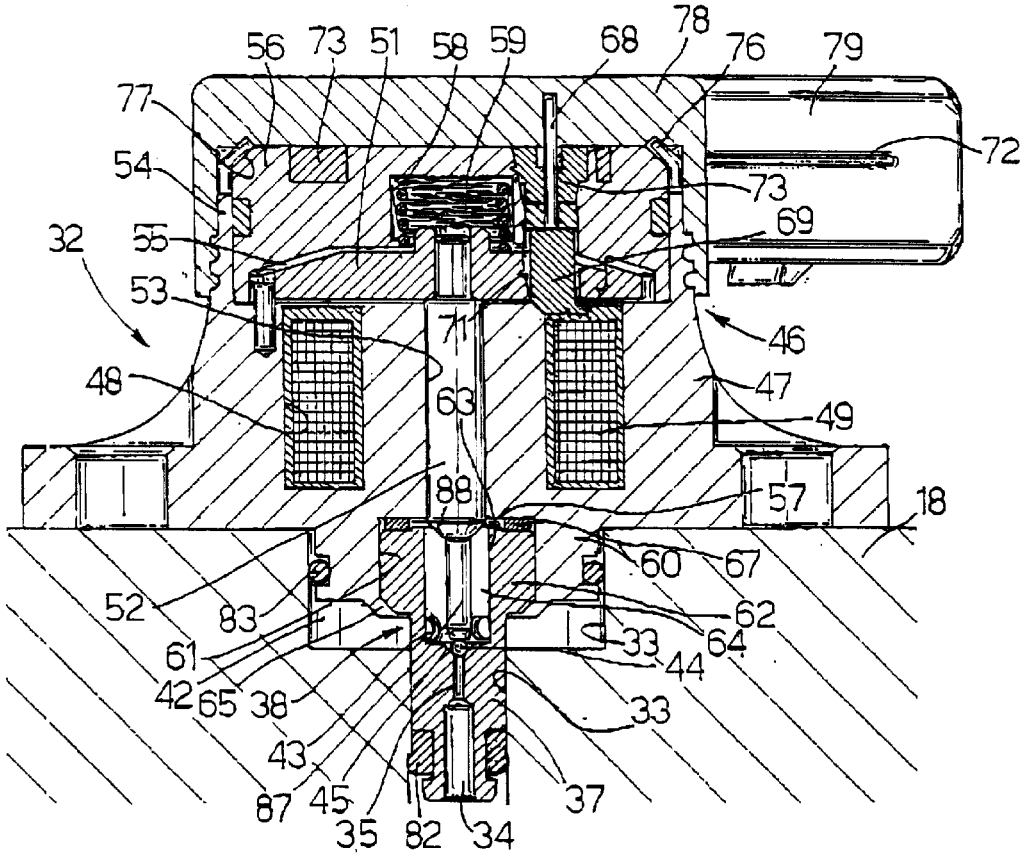
FIG. 2 shows a larger-scale diametrical section of a solenoid valve forming part of the FIG. 1 regulating device according to a first embodiment of the invention.
Figure 4:
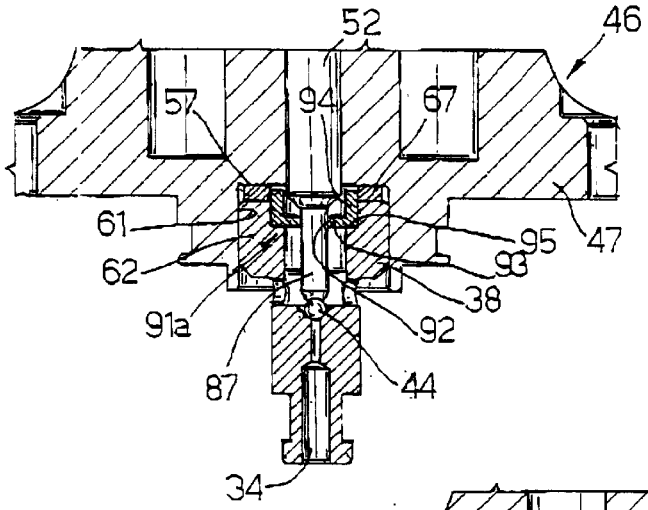
FIG. 4 shows the FIG. 3 detail according to a further embodiment of the invention.

Valve body 38 is fixed inside seat 61 by bending an annular edge 65 of appendix 60 from the FIG. 4 to the FIG. 2 position, so as to firmly engage a beveled edge 66 of portion 62. This is done via the interposition of an adjusting element, e.g. a calibrated washer 67 inserted between shoulder 57 and the end surface of portion 62. To position washer 67 easily, the end surface of portion 62 has a rib 70.

Washer 67 is selected from a series of modular washers 67, differing from one another by two micron in thickness, so as to achieve a stop position of stem 52 in which a predetermined gap is left between armature 51 and the pole pieces of core 47, to improve the response of armature 51 to variations in the excitation of solenoid 49.

Solenoid 49 is provided with the usual terminals 68 (FIG. 2), which are comolded partly with solenoid 49 in insulating material forming two appendixes 69 (only one shown in FIG. 2). Appendixes 69 are inserted inside two holes 71 in armature 51; and the two terminals 68 are soldered to two metal pins 72 for connection to an electric plug comolded previously in a ring 73 of insulating material inserted inside head 56.

Head 56 is then fixed in fluidtight manner inside hollow portion 54 of core 47, by bending an annular edge 76, similar to edge 65, of portion 54 to firmly engage a beveled edge 77 of head 56. Portion 54 and head 56 are comolded into a block 78 comprising the usual guard 79 for pins 72; and, finally, solenoid valve 32 is fitted in fluidtight manner inside seat 33 of pump body 18 by means of bolts and via the interposition of appropriate seals 82 and 83 on portion 37 of valve body 38 and on appendix 60 of core 47.

Control unit 31 (FIG. 8) receives electric signals indicating various operating parameters of the engine, such as engine speed, power output, power demand, fuel consumption, etc. A pulse generator 84 generates clipped pulses of predetermined frequency, and is connected to a modulator 86, for modulating the duty cycle of the pulses, to control electromagnet 46 using the PWM technique. Modulator 86 is such as to vary the duty cycle of the pulses between 1% and 99%.

Solenoid 49 (see also FIG. 2) of electromagnet 46 is controlled by the duty cycle generated by modulator 86. For which purpose, unit 31 receives a signal from pressure sensor 29, and processes it as a function of the other parameters to control modulator 86 accordingly.

The above pressure regulating device operates as follows.

Normally, electromagnet 46 (FIGS. 1 and 2) is deenergized, and supply conduit 34 is closed by ball 44 and spring 59. When pump 16 is on, fuel is fed along delivery conduit 26 to common rail 27, thus increasing pressure. When the fuel pressure in common rail 27, and therefore in delivery conduit 26 and supply conduit 34, exceeds a given minimum value, it would overcome the force of spring 59 on ball 44. Since the signal emitted by modulator 86, however, then energizes solenoid 49, to the force of spring 59 is added the magnetic force of electromagnet 46 on armature 51.

When the fuel pressure in common rail 27 exceeds the pressure requested by control unit 31, modulator 86 reduces the duty cycle, thus reducing the magnetic force on armature 51. The fuel pressure in supply conduit 34 therefore overcomes the resultant of the force of spring 59 and of the magnetic force on ball 44, which is released from seat 45, so that supply conduit 34 is connected to holes 43, and therefore to drain conduit 36, and part of the pumped fuel is drained into tank 13.

According to the invention, the regulating device comprises various means for reducing disturbance in the fuel pressure in delivery conduit 26 and therefore in common rail 27. More specifically, such means comprise cutoff chamber 64 for cutting off the hydraulic wave between supply conduit 34 and drain conduit 36, and the volume of which is such as to sufficiently reduce disturbance in delivery conduit 26. Stem 52 advantageously comprises a small-diameter end portion 87 separated from the rest of stem 52 by a connecting shoulder 88. Preferably, the diameter of portion 87 ranges between ⅓ and ⅔ that of stem 52, and portion 87 may extend the full height of chamber 64.

Figure 5:
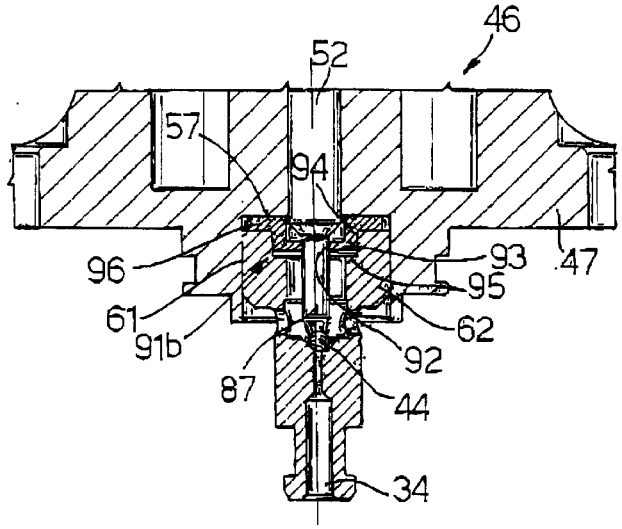
FIGS. 5 and 6 show two variations of the FIG. 4 detail.
Figure 6:
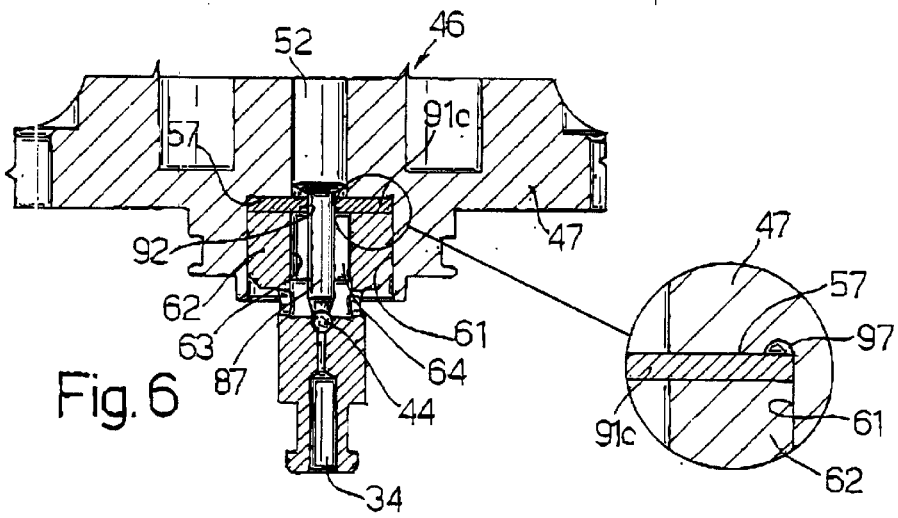

In a further embodiment of the invention, a fixed shield 91*a*, 91*b*, 91*c* (FIGS. 4–6) is inserted between cutoff chamber 64 and shoulder 88. More specifically, shield 91*a*, 91*b*, 91*c* is fixed between valve body 38 and core 47, and has an opening or hole 92 in which small-diameter portion 87 slides with a minimum amount of clearance, so that the variable fuel pressure in cutoff chamber 64 acts on the surface of shield 91*a*, 91*b*, 91*c*, as opposed to shoulder 88, thus greatly reducing the pressure action on stem 52.

Figure 3:
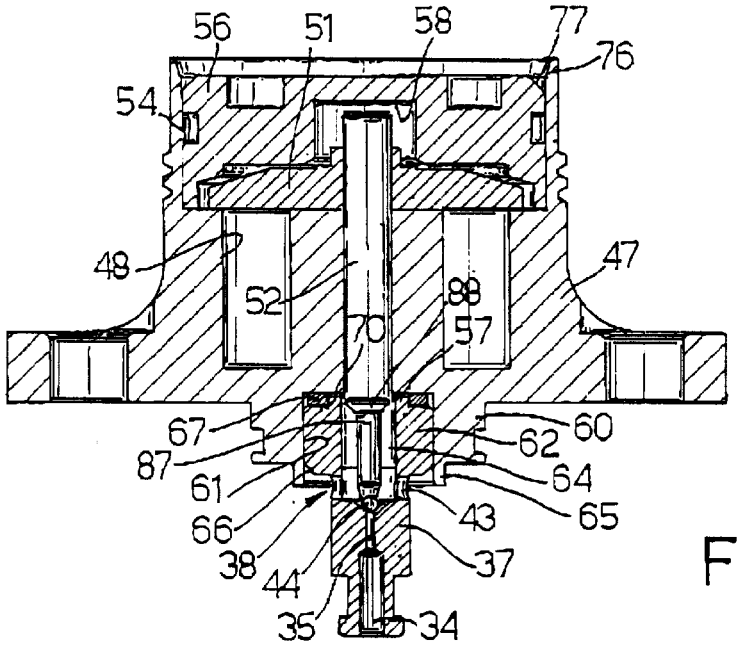
FIG. 3 shows the schematic FIG. 2 section to a slightly smaller scale and at one stage in the assembly of the solenoid valve.

In a first variation (FIG. 4), shield 91*a* is cup-shaped with a flat wall 93 and a cylindrical wall 94; and portion 62 of valve body 38 has a shoulder 95 forming a seat for receiving cylindrical wall 94 of shield 91*a*, which thus replaces the FIG. 3 rib 70 for positioning washer 67.

In a further variation (FIG. 5), shield 91*b* is cup-shaped as in FIG. 4, but cylindrical wall 94 comprises a flange 96, which is inserted between the end surface of portion 62 of valve body 38 and shoulder 57 of core 47 to replace washer 67. Shield 91*b* is therefore selected from a series of shields 91*b*, with flanges 96 of modular thickness like washers 67 in FIG. 3, and therefore defines the adjusting element of valve body 38. In this case, there is obviously a certain amount of clearance between flat wall 93 of shield 91*b* and shoulder 95 of portion 62 of valve body 38.

In a further variation (FIG. 6), portion 62 of valve body 38 has no rib 70 and no shoulder 95; shield 91*c* is defined by a washer with an outside diameter substantially equal to that of axial seat 61 in appendix 60 of core 47; and central hole 92 has substantially the same diameter as portion 87 of stem 52.

In this case, shoulder 57 of seat 61 of core 47 comprises an annular groove 97 enabling accurate machining of the entire surface of shield 91*c* resting on shoulder 57. The washer of shield 91*c* is selected from a series of washers 91*c* of modular thicknesses, and so forms an extremely economical adjusting element of valve body 38. Shield 91*c* in the form of a washer obviously also provides for greatly simplifying the formation of seat 61 in valve body 38.

Figure 7:
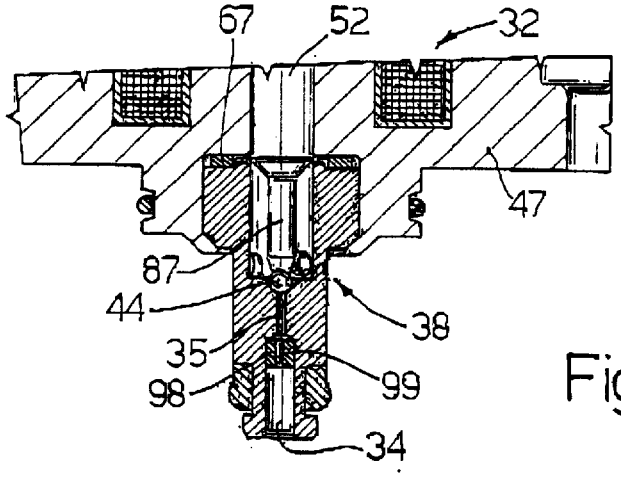
FIG. 7 shows a further detail of FIG. 2 according to a further variation of the invention.

The means for reducing disturbance in the delivery pressure of high-pressure pump 16 may comprise, or be defined by, a choking element 98 (FIG. 7) fitted removably inside supply conduit 34 of solenoid valve 32. More specifically, choking element 98 may be defined by a cylindrical block with a calibrated axial hole 99.

Provision may advantageously be made for a series of cylindrical blocks 98 with the same outside diameter but with holes 99 of modular diameters, so that each solenoid valve 32 may be fitted with the block 98 best suited to reduce disturbance in the delivery pressure of pump 16. The diameter of hole 99 preferably ranges between 6/10 and 10/10 the diameter of portion 35 of supply conduit 34.

The means for reducing disturbance in the delivery pressure of high-pressure pump 16 may also comprise a choking member 100 (FIG. 1) fitted removably inside delivery conduit 26 of pump 16, and which may be defined by a fitting having a calibrated hole 101 inside a seat 102 of delivery conduit 26. Tests have shown disturbance to be best reduced with a hole 101 of less than 0.7 mm in diameter. The diameter of hole 101 preferably ranges between 0.5 and 0.7 mm.

Both block 98 and fitting 100 may be provided independently or in combination with each other and/or with shield 91*a*, 91*b*, 91*c* of cutoff chamber 64, seeing as how each is more effective under particular operating conditions. As regards the speed of pump 16, in particular, both block 98 and fitting 100 provide for a greater reduction in pressure disturbance at pump 16 speeds of over 2000 rpm.

As regards the fuel pressure required in common rail 27, block 98 provides for a greater reduction in pressure disturbance at pressures of over 600 bar, whereas fitting 100 provides for a greater reduction in disturbance at pressures below 700 bar. Whichever the case, the reduction in pressure disturbance effected by block 98 and fitting 100 is in addition to those effected by shield 91.

As is known, solenoid valve 32 has a resonance frequency, which, in the above case, normally ranges between 500 and 650 Hz. In certain conditions, any pressure disturbance may initiate forced oscillations of solenoid valve 32, resulting in an enormous increase in disturbance, so that the means for reducing pressure disturbance must be selected with a view to avoiding resonance phenomena.

During actual operation of the pressure regulating device, the forces acting on ball 44 are not constant, not only on account of the pulsating flow components caused by intermittent operation of pump 16 and injectors 28, and by PWM control of electromagnet 46, but also for other mechanical reasons, such as the gap of armature 51, the position of ball 44 with respect to seat 45, and friction between stem 52 and hole 53.

As opposed to remaining in a fixed position, both ball 44 and armature 51 of electromagnet 46 therefore oscillate or "dither" about a point of equilibrium. When of limited amplitude, dither helps to minimize friction between stem 52 and hole 53, so that the control frequency of electromagnet 46 may be used to control dither amplitude. For example, at low operating speeds of pump 16 and when low pressure is required in common rail 27, dither must be intensified using a low PWM-control frequency, e.g. of about 400 Hz.

Conversely, when of high amplitude, e.g. at high operating speeds of pump 16 and when high pressure is required in common rail 27, dither may impair regulation of the pressure in common rail 27. In which case, the pulsating effect caused by electrical control of electromagnet 46 must be minimized using a sufficiently high control pulse frequency of, say, about 2000 Hz.

In a further embodiment of the invention, to control dither amplitude, the pressure disturbance reducing means may comprise a circuit 103 for varying the frequency of the control signals emitted by pulse generator 84. For which purpose, circuit 103 is preferably controlled automatically by unit 31 to select, each time, the frequency of the control pulses generated by generator 84 best suited to achieve a maximum reduction of hydraulic pressure disturbance in common rail 27.

Unit 31 is therefore programmed to control circuit 103 to select frequency on the basis of an estimate of disturbances depending on one or more parameters, which may comprise the hydraulic pressure required in common rail 27, the speed of pump 16 and the internal combustion engine, the amount of fuel injected into the engine cylinders, i.e. the output power of the engine, and the position of the accelerator pedal.

Circuit 103 may also be regulated empirically by hand to prevent generator 84 from generating pulses with a frequency substantially equal to the resonance frequency of solenoid valve 32 and feed system 10. In the case of solenoid valve 32 described above, circuit 103 is preferably so regulated that generator 84 generates control pulses with a frequency of at least 1500 Hz.

Figure 9:
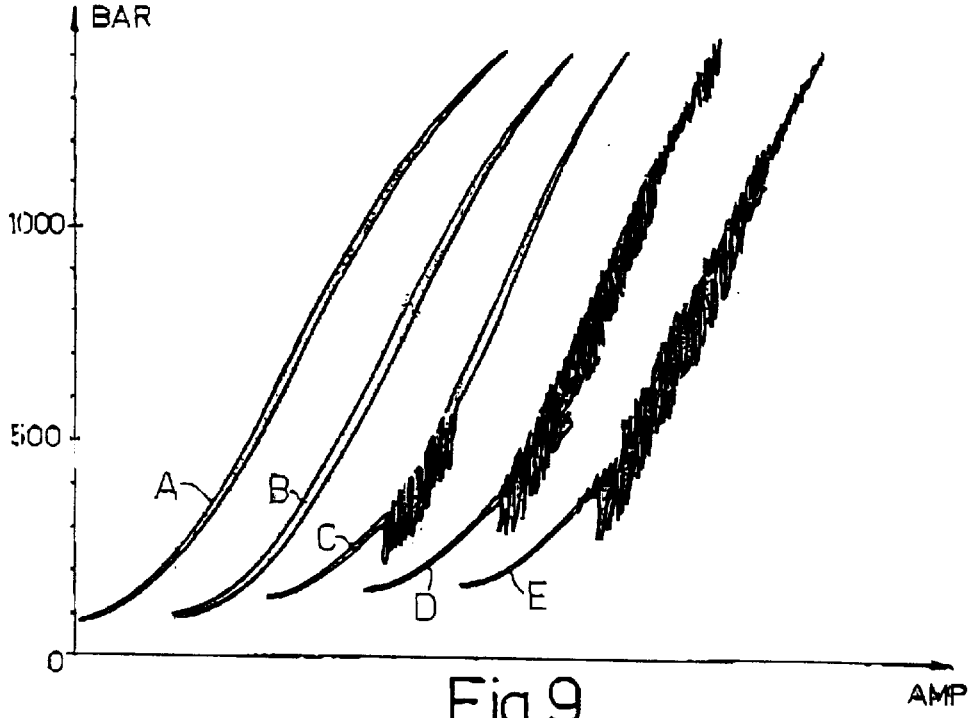
FIGS. 9 and 10 show two operating graphs of a known regulating device.

The FIG. 9 graph shows the pressure in delivery conduit 26 as a function of regulating current supplied to a conventional open-loop-controlled solenoid valve in 1667 Hz frequency pulses. The five curves A–E show pressure relative to pump 16 operating speeds increasing from left to right.

More specifically, curve A relates to a pump 16 speed of 500 rpm, and its lowest point to zero excitation current; and curves B, C, D and E relate respectively to pump 16 speeds of 1000, 1500, 2000 and 2500 rpm, and the respective lowest points to zero excitation current. As can be seen, the 1500 rpm curve C shows severe disturbance at pressures below 600 bar, while curves D and E relative to speeds of 2000 and 2500 rpm show severe disturbance at practically any pressure.

Figure 10:
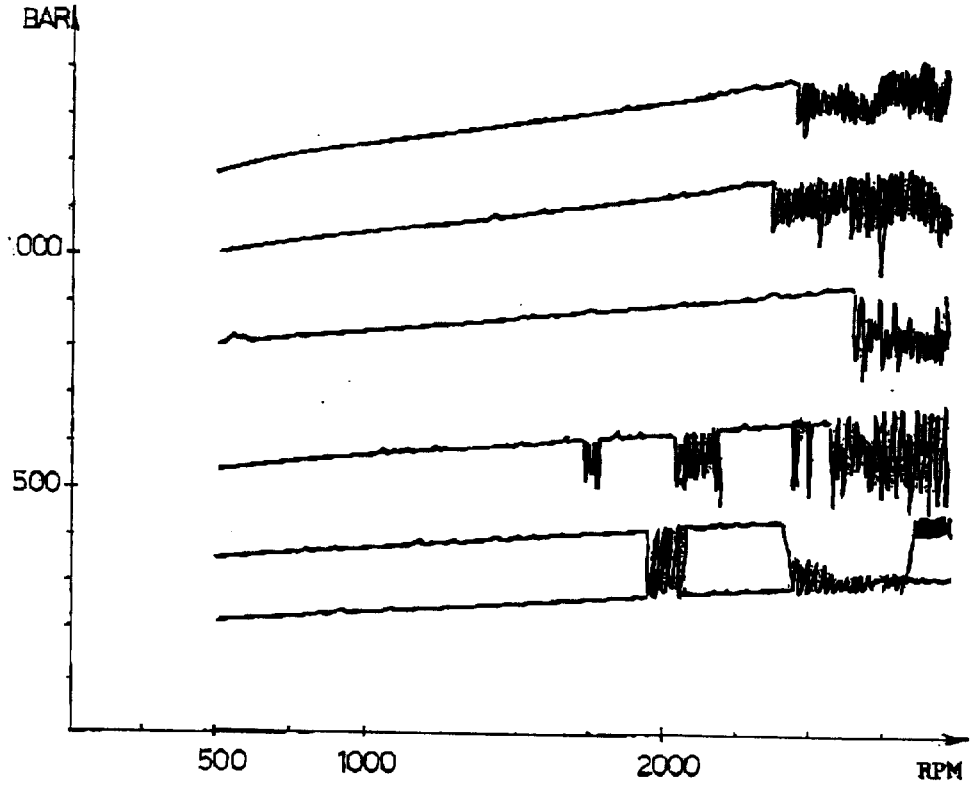

FIG. 10 shows a pressure versus pump 16 speed graph relative to the same solenoid valve as in FIG. 9. The six curves show pressure relative to electromagnet 47 supply currents ranging from 0.75 to 2 amp, and increasing by 0.25 amp from the bottom curve upwards. As can be seen, with the exception of the bottom curve relative to excessively low pressures, all the curves show severe pressure disturbance at higher speeds.

Figure 11:
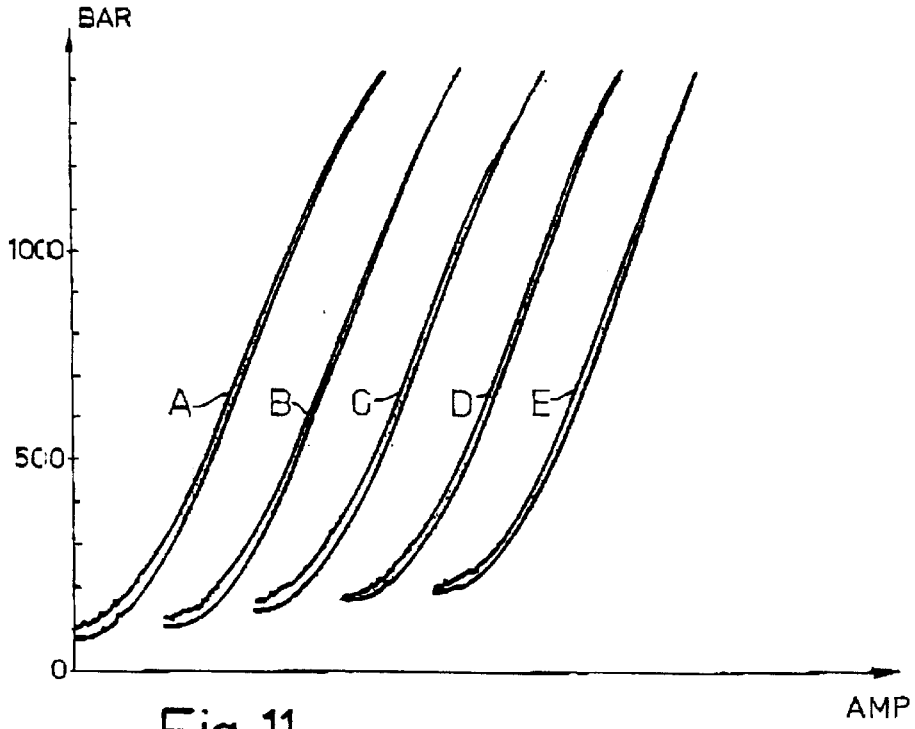
FIGS. 11 and 12 show two operating graphs, as in FIGS. 9 and 10, of a regulating device according to the FIG. 6 variation and controlled by pulses of a given frequency.
Figure 12:
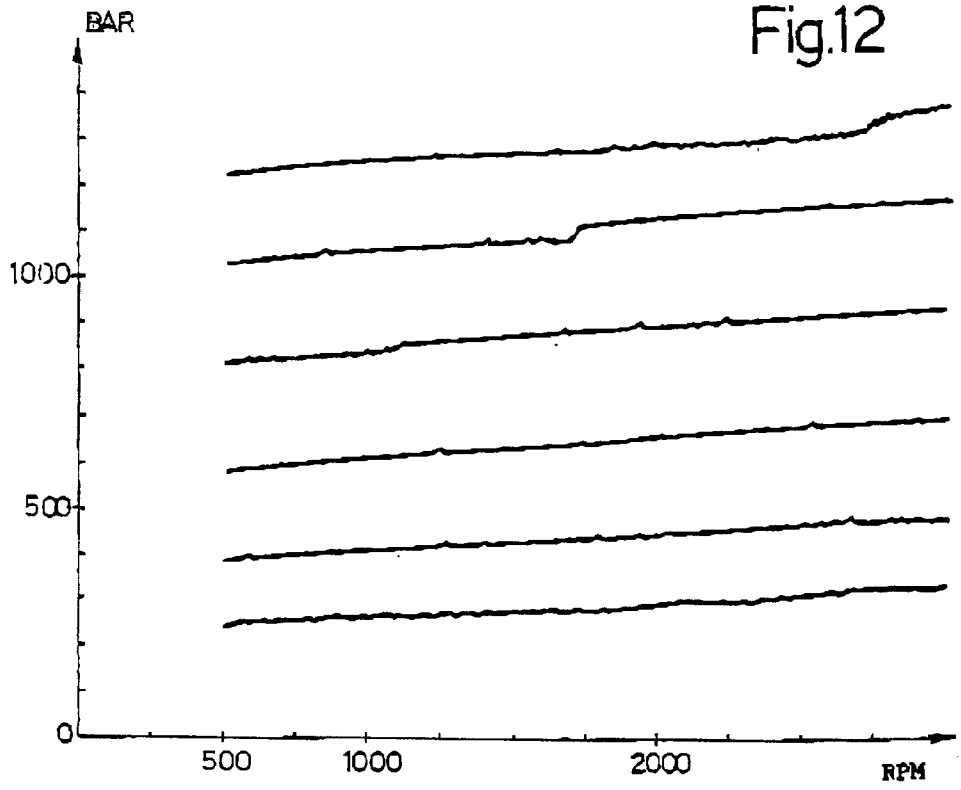

FIGS. 11 and 12 show the same graphs as in FIGS. 9 and 10, but relative to a regulating device controlled by 833 Hz frequency pulses, and wherein solenoid valve 32 is provided with a shield 91*c* (FIG. 6), and delivery conduit 26 (FIG. 1) with a choking member 100 with a hole 101 of 0.65 mm in diameter. As shown in FIGS. 11 and 12, at low pressures and low pump 16 speeds, there is only a slight disturbance in the pressure in common rail 27.

Figure 13:
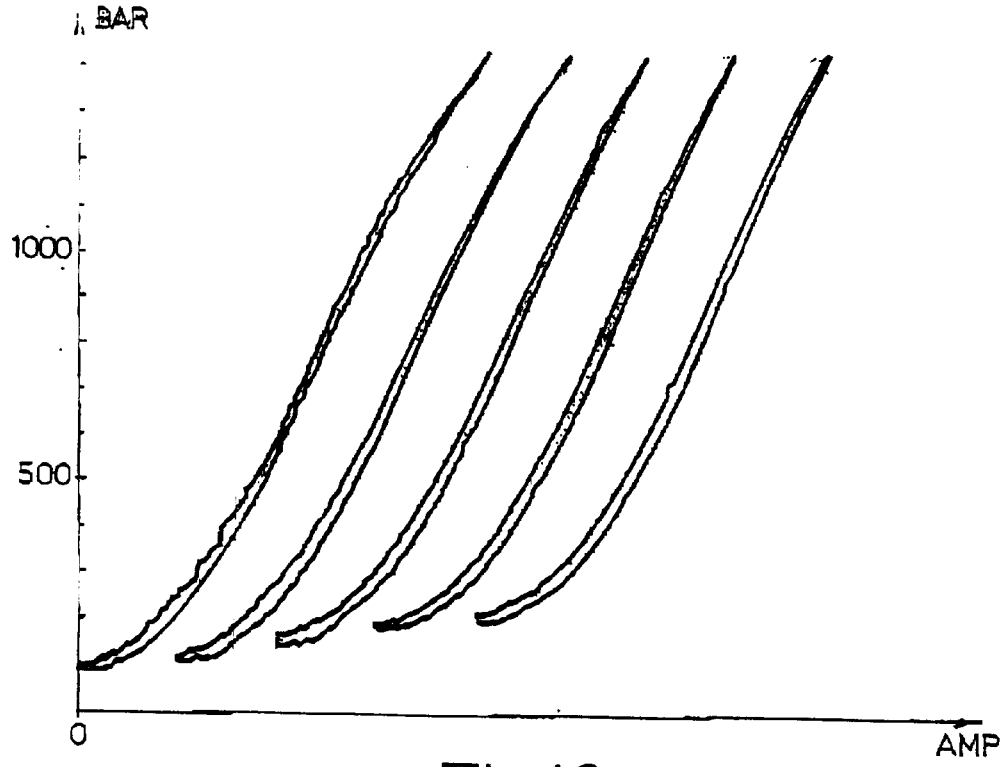
FIGS. 13 and 14 show a further two operating graphs, as in FIGS. 11 and 12, of the same regulating device controlled by pulses of a different frequency.
Figure 14:
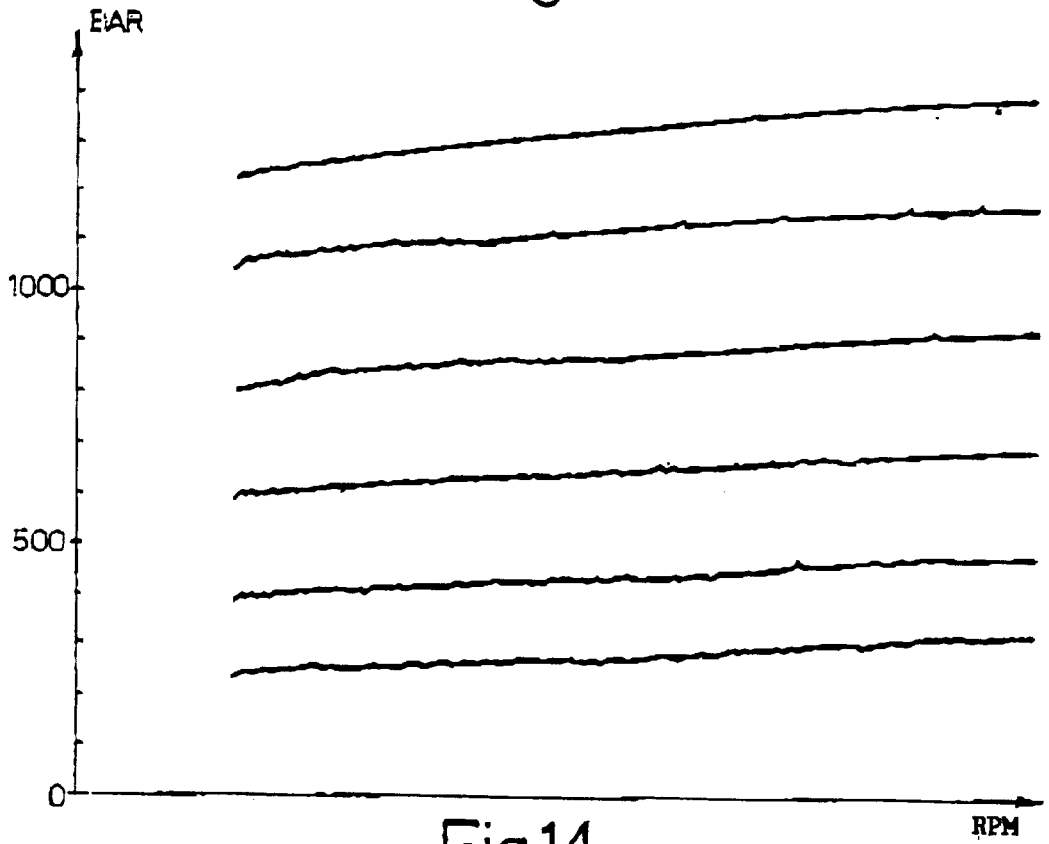

FIGS. 13 and 14 show the same graphs as in FIGS. 9 and 10, but relative to a regulating device controlled by 1667 Hz frequency pulses, and wherein solenoid valve 32 is provided with a shield 91*c,* and delivery conduit 26 with a 0.65 mm diameter choking member as in FIGS. 11 and 12, and supply conduit 34 is provided with a 0.5 mm diameter choking element. As shown in FIGS. 13 and 14, pressure disturbance is eliminated at practically all common rail 27 pressures and all pump 16 speeds.

As compared with known devices, the advantages of the regulating device according to the invention will be clear from the foregoing description. In particular, both cutoff chamber 64 and choking element 98 of supply conduit 34, or delivery conduit choking member 100, provide for reducing fuel pressure disturbance in common rail 27.

Moreover, shield 91*a*, 91*b*, 91*c* eliminates the piston effect created on armature 51 by the pressure in cutoff chamber 64. And finally, selecting the frequency of the control pulses of solenoid 49 of solenoid valve 32 eliminates pressure disturbance caused both by resonance of the frequency of the device itself, and by the specific operating conditions of the engine.

Clearly, changes may be made to the regulating device as described herein without, however, departing from the scope of the accompanying claims. For example, armature 51 of electromagnet 46 may be cylindrical, as opposed to disk-shaped; the volume of cutoff chamber 64 may also be increased by varying the height and/or diameter of cavity 63; and solenoid valve 32 may be located on common rail 27, as opposed to pump 16.

What is claimed is:

1. A device for regulating a delivery pressure of a pump for feeding fuel to an internal combustion engine, the device comprising a solenoid valve having a supply conduit communicating with a delivery conduit of said pump, a drain conduit, a shutter between said supply conduit and said drain conduit, an electromagnet energized variably to control an armature controlling said shutter, a cutoff chamber for cutting off hydraulic pressure between said supply conduit and said drain conduit, said cutoff chamber being of such a volume as to reduce variation in said hydraulic pressure on said armature, wherein said armature comprises a cylindrical stem having a portion housed in said cutoff chamber and connected to said stem by a shoulder, said portion having a diameter smaller than a diameter of said stem to increase the volume of said cutoff chamber, and a fixed shield defining said cutoff chamber and having an opening in which said portion slides so as to eliminate a piston effect of the hydraulic pressure in said chamber on said stem.

2. A device as claimed in claim 1, characterized in that the diameter of said portion (87) ranges between ⅓ and ⅔ that of said stem (52).

3. A device as claimed in claim 1, wherein said electromagnet (46) comprises a core (47) having an annular solenoid (49); said stem (52) sliding inside an axial hole (53) in said core (47); and said chamber (64) being formed in a valve body (38) adapted to be connected to said delivery conduit (26); characterized in that said shield (91*a*, 91*b*, 91*c*) is located between said valve body (38) and said core (47).

4. A device as claimed in claim 3, characterized in that an adjusting element (67, 96, 91*c*) is located between said valve body (38) and a shoulder (57) of said core (47), and is selectable from a series of adjusting elements (67, 96, 91*c*) of modular thicknesses and such as to permit modular adjustment of a stop position of said armature (51) when said electromagnet (46) is energized.

5. A device as claimed in claim 4, characterized in that said shield is in the form of a cup (91*a*) inserted inside a seat on the valve body (38); said adjusting element being defined by a separate washer (67) of modular thickness.

6. A device as claimed in claim 3, characterized in that said shield is in the form of a cup (91*b*) inserted inside a seat on said valve body (38); said cup (91*b*) having a spacer flange (96) located between said valve body (38) and a shoulder (95) of said core (47); and said cup (91*b*) being selectable from a series of cups (91*b*) with flanges (96) of modular thicknesses.

7. A device as claimed in claim 3, characterized in that said shield is in the form of a flat washer (91*c*) located between said valve body (38) and a shoulder (95) of said core (47); said flat washer (91*c*) being selectable from a series of flat washers (91*c*) of modular thicknesses.

8. A device as claimed in claim 1, wherein said supply conduit 34 has a portion (35) having a predetermined calibrated diameter and comprising a choking element (98) located removably inside said supply conduit (34); said choking element (98) having a calibrated hole (99) of a diameter smaller than that of said portion (35) of the supply conduit (34).

9. A device as claimed in claim 8, characterized in that the diameter of the hole (99) of said choking element (98) ranges between 6/10 and 10/10 that of said portion (35) of the supply conduit (34).

10. A device as claimed in claim 1, characterized in that said electromagnet (46) is controlled by an electronic unit (31) comprising a generator (84) for generating pulses of a predetermined frequency, and a modulator (86) for modulating a duty cycle of said pulses; and wherein said pump is a high-pressure pump (16) of a fuel feed system (10) comprising a delivery conduit (26) connected to a common distributor (27) for engine cylinders.

11. A device as claimed in claim 10, wherein said supply conduit (34) communicates with said delivery conduit (26) and comprising a choking member (100) located inside said delivery conduit (26); said choking member (100) having a calibrated hole (101) smaller than 0.7 mm in diameter.

12. A device as claimed in claim 11, characterized in that the calibrated hole (101) of said choking member (100) has a diameter ranging between 0.5 and 0.7 mm.

13. A device as claimed in claim 10, wherein the generator (84) is conditioned to generate such a frequency of pulses as to avoid a resonance frequency of said solenoid valve (32).

14. A device as claimed in claim 13, characterized in that said generator (84) is so conditioned as to generate pulses of no less than 1500 Hz frequency.

15. A device as claimed in claim 13, characterized in that said generator (84) is driven by said electronic unit (31) by means of a frequency selection circuit (103) for selecting the frequency of said generator (84) on the basis of an estimate of hydraulic disturbances depending on an operating parameter selected from the group consisting of the hydraulic pressure in said distributor (27); the speed of said pump (16) and the engine; and the power supplied by and/or requested of the engine.

16. A device for regulating a delivery pressure of a pump for feeding fuel to an internal combustion engine, the device comprising a solenoid valve having a supply conduit communicating with a delivery conduit of said pump, a drain conduit, a shutter between said supply conduit and said drain conduit, an electromagnet energized variably to control an armature, said supply conduit having a portion of a predetermined calibrated diameter, said armature being urged by a spring to cause said shutter to close said supply conduit, said electromagnet acting on said armature to variably supplement the urge of said spring, a cutoff chamber for cutting off hydraulic pressure between said supply conduit and said drain conduit, said cutoff chamber being of such a volume as to reduce variation in the hydraulic pressure on said armature, wherein said armature comprises a cylindrical stem having a portion housed in said cutoff chamber and connected to said stem by a shoulder, said portion having a diameter smaller than a diameter of said stem to increase the volume of said cutoff chamber, and wherein a choking element is located removably inside said supply conduit, said choking element having a calibrated hole of a diameter smaller than the calibrated diameter of said portion of the supply conduit, the choking element being selectable from a series of choking elements having calibrated holes of modular diameter to permit modular adjustment of a relevant flow rate.

17. A device for regulating a delivery pressure of a pump for feeding fuel to an internal combustion engine, the device comprising a solenoid valve having a supply conduit communicating with a delivery conduit of said pump, a drain conduit, a shutter between said supply conduit and said drain conduit, an electromagnet energized variably to control an armature, said armature being urged by a spring to cause said shutter to close said supply conduit, said electromagnet acting on said armature to variably supplement the urge of said spring, a cutoff chamber for cutting off hydraulic pressure between said supply conduit and said drain conduit, said cutoff chamber being of such a volume as to reduce variation in said hydraulic pressure on said armature, wherein said armature comprises a cylindrical stem having a portion housed on said cutoff chamber and connected to said stem by a shoulder, said portion having a diameter smaller than a diameter of said stem to increase the volume of said cutoff chamber, and wherein a choking member is removably located inside said delivery conduit, said choking member having a calibrated hole with a diameter ranging between 0.5 and 0.7 mm, the choking member being selectable from a series of choking members of a modular diameter to permit modular adjustment of a relevant flow rate.

18. A device for regulating a delivery pressure of a high-pressure pump for feeding fuel to an internal combustion engine, the device comprising a solenoid valve having a supply conduit communicating with a delivery conduit of said pump connected to a common rail for a set of fuel injectors, a drain conduit, a shutter between said supply conduit and said drain conduit, an electromagnet energized variably to control an armature, said electromagnet being controlled by an electronic unit comprising a generator for generating pulses of a predetermined frequency, and a modulator for modulating a duty cycle of said pulses, said armature being urged by a spring to cause said shutter to close said supply conduit, said electromagnet acting on said armature to variably supplement the urge of said spring, a cutoff chamber for cutting off hydraulic pressure between said supply conduit and said drain conduit, said cutoff chamber being of such a volume to reduce variation in said hydraulic pressure on said armature, wherein said armature comprises a cylindrical stem having a portion housed in said cutoff chamber and connected to said stem by a shoulder, said portion having a diameter smaller than a diameter of said stem to increase the volume of said cutoff chamber, and wherein disturbance reducing means are associated with said conduits for reducing a pressure disturbance on said armature.

* * * * *